US010196788B2

(12) United States Patent
Yamazaki et al.

(10) Patent No.: US 10,196,788 B2
(45) Date of Patent: Feb. 5, 2019

(54) SNOW PLOW

(71) Applicant: HONDA MOTOR CO., LTD., Tokyo (JP)

(72) Inventors: Nobuo Yamazaki, Wako (JP); Shota Tanabe, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/458,117

(22) Filed: Mar. 14, 2017

(65) Prior Publication Data

US 2018/0266063 A1 Sep. 20, 2018

(30) Foreign Application Priority Data

Mar. 16, 2016 (JP) ..... 2016-052354

(51) Int. Cl.
*E01H 5/04* (2006.01)
*E01H 5/06* (2006.01)

(52) U.S. Cl.
CPC ..... *E01H 5/04* (2013.01); *E01H 5/061* (2013.01)

(58) Field of Classification Search
CPC ..... E01H 5/06; E01H 5/061; E01H 5/066; E01H 5/04
USPC ..... 280/9
See application file for complete search history.

(56) References Cited

U.S. PATENT DOCUMENTS 1,907,321 A * 5/1933 Hilstrom ..... B62B 19/00 280/9
2,398,142 A * 4/1946 Hnat ..... B62B 13/18 280/23.1
2,536,166 A * 1/1951 Garland ..... E01H 5/04 180/9
2,683,608 A * 7/1954 Matheson ..... B62B 13/18 180/183
2,889,779 A * 6/1959 Hofer ..... E02F 3/907 37/311
3,132,873 A * 5/1964 Sychowski ..... B62M 27/02 188/8
4,288,087 A * 9/1981 Morrison ..... B62B 17/00 180/182

(Continued)

FOREIGN PATENT DOCUMENTS

JP 54-41036 U1 3/1978
JP 58-121703 U 8/1983

(Continued)

OTHER PUBLICATIONS

Office Action dated Oct. 24, 2017, issued in counterpart Japanese Application No. 2016-052354, with English translation. (6 pages).

*Primary Examiner* — Jamie L McGowan
(74) *Attorney, Agent, or Firm* — Westerman, Hattori, Daniels & Adrian, LLP

(57) ABSTRACT

A snow plow, includes a snow plowing part in the front of a machine body having a wheel and a blade; and an operating handle extending rearward from the machine body. The blade is provided at the machine body to be able to be lifted or lowered between a storage position at which the blade is lifted above lowermost surface of the wheel and a usage position at which the blade is lowered below the lowermost surface of the wheel. Any one of the operating handle and the machine body includes an operating member configured to operate the blade such that the blade is lifted or lowered between the storage position and the usage position.

4 Claims, 6 Drawing Sheets

(56) References Cited

U.S. PATENT DOCUMENTS 5,101,585 A * 4/1992 Gerbrandt ..... E01H 5/04 37/249
5,485,690 A * 1/1996 MacQueen ..... E01H 5/06 172/212
5,666,747 A * 9/1997 MacQueen ..... E01H 5/06 280/79.11
7,290,774 B2 * 11/2007 Despres ..... B62B 13/18 180/182
7,500,678 B1 * 3/2009 Whiting ..... B64C 25/52 244/108
7,730,642 B2 * 6/2010 Sugiura ..... E01H 5/04 180/53.1
8,915,501 B2 * 12/2014 Forcier ..... B62B 13/18 180/183
2001/0009079 A1 * 7/2001 Kono ..... E01H 5/04 37/246
2002/0135142 A1 * 9/2002 Hinds ..... B62K 3/002 280/9
2003/0222417 A1 * 12/2003 Ouellette ..... B62B 13/18 280/9
2009/0183395 A1 * 7/2009 Sugiura ..... E01H 5/04 37/259
2010/0064556 A1 * 3/2010 Lau ..... A01B 45/00 37/242
2011/0314707 A1 * 12/2011 Raftery ..... E01H 5/045 37/224
2011/0315465 A1 12/2011 Henry
2014/0250739 A1 * 9/2014 Distefanis, Jr. ..... E01H 5/045 37/260
2015/0007461 A1 1/2015 Schmalz
2016/0281310 A1 * 9/2016 Muntasser ..... E01H 5/098
2017/0267297 A1 * 9/2017 Maile ..... B62D 55/14

FOREIGN PATENT DOCUMENTS

JP 63-60166 B2 11/1988
JP 2010-150925 A 7/2010
JP 2015-57382 A 3/2012

* cited by examiner

SNOW PLOW

CROSS-REFERENCE TO RELATED APPLICATION

Priority is claimed on Japanese Patent Application No. 2016-52354, filed Mar. 16, 2016, the content of which is incorporated herein by reference.

BACKGROUND OF THE INVENTION

Field of the Invention

The present invention relates to a snow plow configured to move smoothly on both a snow-covered surface and a road surface such as a paved road which is not covered with snow (hereinafter referred to as a "non-snow-covered surface") when removing snow or moving.

Description of Related Art

In the related art, a snow plow in which an auger configured to gather snow using a motor mounted in a machine body (a base) is rotatably driven and the snow gathered by the auger is discharged through a chute using a blower is known.

A snow plow of which a machine body (a base or the like) includes wheels and a blade used for movement is put to practical use.

A snow plow including wheels can move smoothly on a non-snow-covered surface, but is disadvantageous in moving on a snow-covered surface because the wheels sink in.

On the other hand, a snow plow including a blade can move smoothly on a snow-covered surface, but does not easily move on a non-snow-covered surface.

Thus, a snow plow including both wheels and a blade has been proposed (for example, refer to Japanese Unexamined Patent Application, First Publication No. 2012-057382 (hereinafter referred to as Patent Literature 1)).

Patent Literature 1 includes a snow plow in which a base 1 (reference numeral of which is the same as that of Patent Literature 1; the same applies below) has a blade 7 and casters 8 (wheels) as shown in FIG. 3 of Patent Literature 1, and the snow plow is moved on a snow-covered surface or a road surface by being manually pushed.

SUMMARY OF THE INVENTION

The snow plow of the invention related to Patent Literature 1 has both the blade and the wheels, but in the case of the wheels, resistance of the wheels is great when the snow plow is moved on a snow-covered surface. Thus, the snow plow is disadvantageous in moving on snow-covered surfaces.

On the other hand, resistance of the blade is great when the snow plow is moved on a non-snow-covered surface. Thus, the snow plow is inconvenient to move on a non-snow-covered surface due to the blade.

Aspects related to the present invention were made in view of the above-described problems, and an object of the present invention is to provide a snow plow which includes a blade and wheels and can move smoothly on both a snow-covered surface and a non-snow-covered surface when the snow plow is moved on the snow-covered surface or the non-snow-covered surface.

In order to accomplish the above-described object, the present invention adopts the following aspects.

(1) A snow plow related to an aspect of the present invention includes a snow plowing part in the front of a machine body having a wheel and a blade; and an operating handle extending rearward from the machine body. The blade is provided at the machine body to be able to be lifted or lowered between a storage position at which the blade is lifted above lowermost surface of the wheel and a usage position at which the blade is lowered below the lowermost surface of the wheel. Any one of the operating handle and the machine body includes an operating member configured to operate the blade such that the blade is lifted or lowered between the storage position and the usage position.

(2) In an aspect of (1), one end portion of the blade in a forward and rearward direction thereof may be supported by the machine body to be able to swing vertically, the blade may be biased by a biasing member in a direction in which a swing distal end portion of the blade swings upward, the swing distal end portion of the blade may be joined to the operating member by a swing actuating mechanism, and the swing actuating mechanism may be a converting mechanism configured to convert an operating force of the operating member into a force by which the swing distal end portion of the blade swings downward.

(3) In an aspect of (2), the swing actuating mechanism may be constituted of a wire cable which has an inner cable and an outer tube and an arm of which middle in a longitudinal direction is supported by the machine body to be able to swing vertically, both ends of the outer tube may be fixed to the machine body, one end of the inner cable may be joined to the operating member, the other end of the inner cable may be joined to one end portion of the arm, and the other end portion of the arm may be engaged such that the swing distal end portion of the blade is able to be pressed downward.

(4) In an aspect of (2), the swing actuating mechanism may be constituted of a wire cable which has an inner cable and an outer tube and a link mechanism configured to join the swing distal end portion of the blade to the machine body to be able to swing vertically, the outer tube may be disposed to be curved, one end of the outer tube may be joined to the machine body, the other end of the outer tube may be joined to the link mechanism, one end of the inner cable may be joined to the operating member, and the other end of the inner cable may be joined to the machine body.

According to the aspect of (1), the wheel and the blade are provided, and the blade can be freely set to storage positions and usage positions. Thus, when the snow plow is moved on a non-snow-covered surface, the blade is lifted upward so that the snow plow can be easily moved on the wheels.

On the other hand, when the snow plow is moved on a snow-covered surface, the blade is lowered to the usage positions while snow is plowed out by the snow plowing part so that the snow plow can be easily moved, and thus a snow plowing task can be easily performed. In addition, since the wheels are above the blade, the wheels do not interfere with movement of the snow plow.

Therefore, the snow plow can be smoothly and easily moved on a snow-covered surface or a non-snow-covered surface to cope with a snow-covered surface and a non-snow-covered surface.

Also, the blade can be easily switched between the storage positions and the usage positions by merely raising or lowering the operating member.

In the case of (2), since the one end portion of the blade is supported in the machine body to be able to swing vertically and is biased upward by the biasing member, the blade can be stably stored in the machine body.

Also, since a swing proximal end portion (one end portion) of the blade is supported in the machine body, there is also an advantage that a worker completes a task with a light operating force of merely operating the swing distal end portion of the blade upward or downward using the operating member.

In the case of (3), since the swing actuating mechanism is constituted of a wire cable which has an inner cable and an outer tube and an arm of which middle in a longitudinal direction thereof is supported by the machine body to be able to swing vertically, both ends of the outer tube are fixed to the machine body, one end of the inner cable is joined to the operating member, the other end of the inner cable is joined to one end portion of the arm, and the other end portion of the arm is engaged such that the distal end portion of the blade is able to be pressed downward, the swing actuating mechanism of the blade can be acquired with a simple constitution.

In the case of (4), since the swing actuating mechanism is constituted of a wire cable which has an inner cable and an outer tube and a link mechanism configured to join the swing distal end portion of the blade to the machine body to be able to swing vertically, the outer tube is disposed to be curved, one end of the outer tube is joined to the machine body, the other end of the outer tube is joined to the link mechanism, one end of the inner cable is joined to the operating member, and the other end of the inner cable is joined to the machine body, the swing actuating mechanism of the blade can be acquired with a simple constitution.

DETAILED DESCRIPTION OF THE INVENTION

Figure 1:
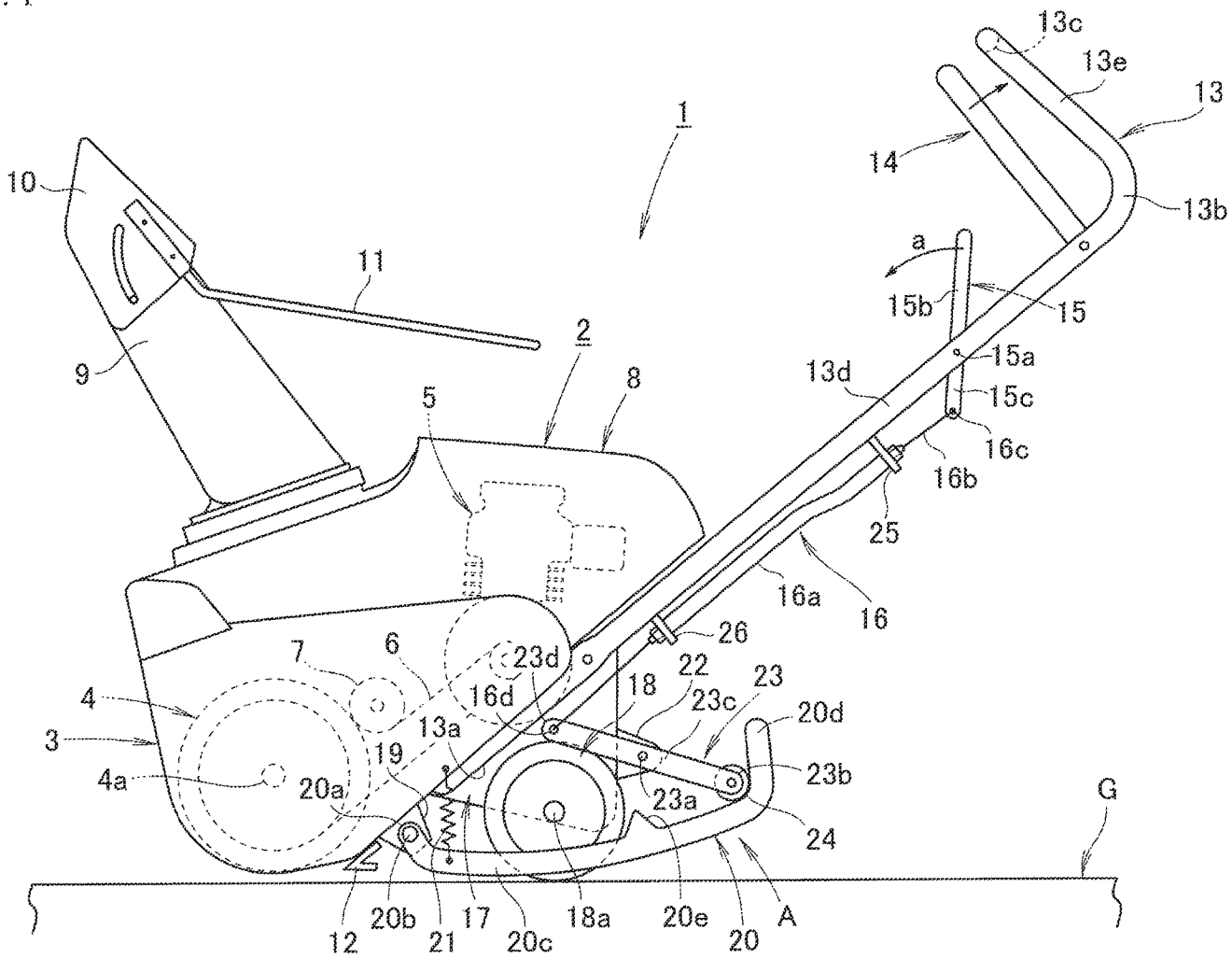
FIG. 1 is a side view showing an external appearance of a snow plow related to a first embodiment of the present invention, and is a view showing a state in which the snow plow can be moved on wheels.

An embodiment of the present invention will be described below with reference to the accompanying drawings. Note that the drawings are assumed to be viewed in a direction in which reference numerals are viewed.

[Embodiment]

FIG. 1 is a side view showing an external appearance of a snow plow 1 related to a first embodiment of the present invention, and is a view showing a state in which the snow plow can be moved on wheels.

An outline of the snow plow 1 will be described.

In a machine body 2 of the snow plow 1, an auger 4 (snow plowing part) is rotatably and horizontally installed via a support shaft 4*a* in an auger housing 3 (snow plowing part) which is open downward and forward.

The auger 4 is driven through a belt 6 by an engine 5 which is disposed in the rear of the auger housing 3.

A roller-shaped auger clutch 7 is provided in the middle of the belt 6, and the auger clutch 7 is rotated so that the belt 6 is tightened and loosened. In addition, transmission of a driving force to the auger through the belt 6 is turned on/off.

An upper portion of the auger housing 3, in which the engine 5 is included, is covered with a cover 8. A chute 9, which extends upward in front thereof, is provided to extend at an intermediate portion in a width direction in the front of the cover 8, and a guide cone 10 configured to adjust a discharge height or a discharge direction of snow is provided at an upper end of the chute 9 to be able to be raised or lowered. Note that reference numeral 11 is a chute lever.

A scraper 12 configured to rake snow into the auger housing 3 by bending the auger housing 3 forward when snow is removed or collected is provided at a lower end portion of the machine body 2, which is near a distal portion of the auger housing 3.

An operating handle 13 extends at a lower surface of the machine body 2 from an intermediate portion thereof to a rear portion thereof to extend upward in the rear thereof. The operating handle 13 has left and right rod portions which are parallel to each other, and has a U shape in a plan view in which the left and right rod portions are bent in an L shape to extend thereabove and upper ends of gripping parts 13*e* are connected by a crossbar 13*c*.

Left and right base portions 13*a* in a lower half of the operating handle 13 are attached and supported at a lower surface of the machine body 2 from an intermediate portion thereof to an upper portion thereof, and upper ends 13*b* protrude to be bent upward, and the crossbar 13*c*, which can be gripped by both of a user's hands, is provided between the upper ends of the left and right bent portions as described above in the embodiment.

At a portion in front of the gripping part 13*e* of a side rod portion 13*d* at one side (a left side) of the operating handle 13, a clutch lever 14 is pivotably supported to be rotatable, and the auger clutch 7 is rotated by rotating the clutch lever 14 in an arrow direction so that the auger clutch 7 approaches or is separated from the belt 6, and the belt 6 is thus tightened or loosened. Thus, power is transmitted to or cut off from the auger 4.

The machine body 2 of the snow plow 1 includes wheels 18 and a blade 20 which are used for movement on a non-snow-covered surface and movement on a snow-covered surface.

A bottom surface of the machine body 2, which is inclined upward toward the rear thereof, has, for example, a substantially triangular shape in a side view in which a base 17 configured to support the wheels 18 protrudes downward, and the base 17 projects downward and rearward. In a lower portion at a rear portion of the base 17, the wheels 18 are rotatably supported via a support shaft 18*a*.

The wheels 18 are constituted as two wheels, lower halves of which also project under the auger housing 3 below the base 17, and which are provided at intervals left and right.

FIG. 1 illustrates a state in which, for example, lower ends of the wheels 18 come into contact with a non-snow-covered surface G such as a paved surface or the like and the wheels 18 can travel on the non-snow-covered surface G.

Left and right brackets 19 protrude downward from a lower portion in the front of the machine body 2 upward in the rear of the scraper 12. In the bracket 19, a front end portion 20*a* of the blade 20, which extends forward and rearward in a side view and has a shallow U shape, is pivotably supported to be rotatable (to swing freely) via a support shaft 20*b*. A pair of left and right blades 20 may be provided or left and right blades 20 may be integrally provided.

A rear portion of a long main body 20*c* of the blade 20, which accounts for most of the blade 20 in a forward and rearward direction, protrudes to be greatly bent upward so that a L-shaped stopper part 20*d* is formed, and a chevron-shaped stopper 20*e* protrudes from an upper edge portion at a site of the main body 20*c*, which is closer to the rear thereof from an intermediate portion thereof in a forward and rearward direction to a rear portion thereof.

The blade 20 includes left and right members. A return spring 21 (biasing member) extends between a part near the support shaft 20*b* of the blade 20 and the machine body 2 side, that is, an intermediate portion in a lower portion of the auger housing 3 in the drawing, and is set as a tensile coil spring in the drawing.

The L-shaped stopper part 20*d* side of the blade 20 is set to be pulled upward by the return spring 21 and lifted to be directed upward using the support shaft 20*b* as a supporting point, and thus is separated from the non-snow-covered surface G.

The blade 20 has a usage and storage positional selection operating arm 23 (hereinafter referred to as an "operating arm") configured to select and set a usage position or a storage position of the blade.

An intermediate portion 23*c* of the operating arm 23 is rotatably supported by a support shaft 23*a* via brackets 22 at an intermediate portion of a rear wall of the base 17.

The arm 23 is at a position that is laterally sunken in a storage position of the blade 20 shown in FIG. 1 and includes freely operable rollers 24 at a distal end portion 23*b* thereof.

In the embodiment, the rollers 24 come in contact with an inner circumferential portion of an L-shaped corner of an L-shaped stopper part 20*d* of the blade 20, a rear portion of the blade 20 is lifted upward, and the blade 20 is separated from the non-snow-covered surface G.

A lifting operating lever 15 (operating member) configured to switch a usage and storage position of the blade 20 is attached to and supported by the rod portion 13*d* of one side (a left side) of the operating handle 13 to be able to rotate via a support shaft 15*a*.

A portion which is above the support shaft 15*a* of the lifting operating lever 15 is a gripping operating part 15*b*, and a distal end portion of a portion 15*c* which is under the support shaft 15*a* is joined to a distal end portion 16*c* of an inner cable 16*b* of an operating wire cable 16.

A proximal end portion 16*d* of an inner cable 16*b* is joined to a proximal end portion 23*d* of the operating arm 23, and the operating wire cable 16 is arranged along a lower surface of a rod portion 13*d* at one side of the operating handle 13.

The operating wire cable 16 is an inside and outside double structure, and both end portions of an outer cable 16*a* (an outer tube) in a longitudinal direction thereof are attached to and supported by a rod portion 13*d* of the operating handle 13 and the machine body 2 side via stays 25 and 26 as described above.

Figure 2:
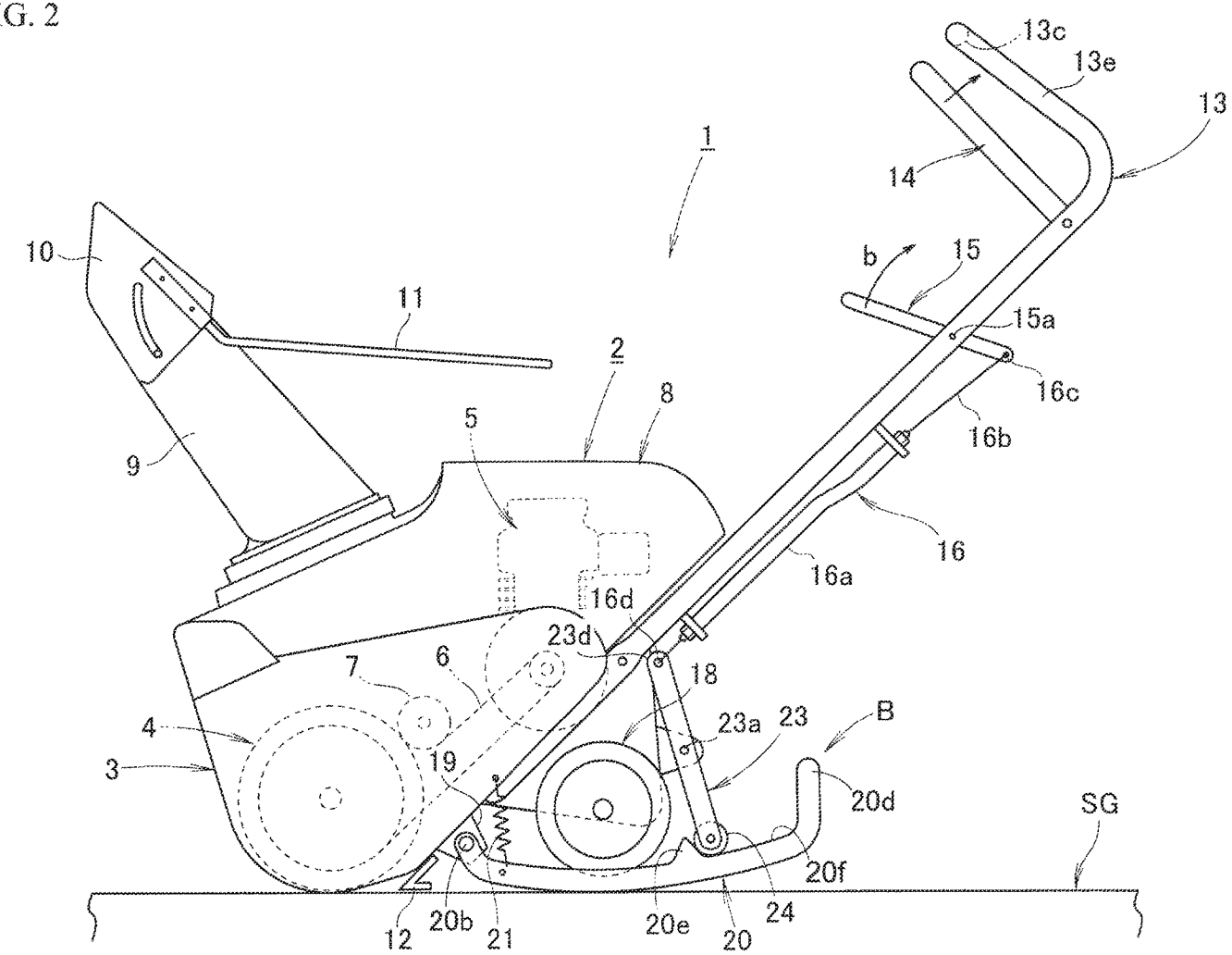
FIG. 2 is a side view of the external appearance of the snow plow in which a blade of the snow plow related to the first embodiment of FIG. 1 is lowered and which is moved on a snow-covered surface.

FIG. 2 is a side view of the external appearance of the snow plow in which the blade of the snow plow is lowered and which is moved on a snow-covered surface.

In FIG. 1, the blade 20 is at a raised position, and is separated from the non-snow-covered surface G, that is, at a storage position A. When the wheels 18 come into contact with the non-snow-covered surface G, and the snow plow is moved while the user grips the operating handle 13 in this state, resistance is small and thus the snow plow can be easily moved with a small force because the snow plow is moved on the wheels 18.

Next, movement on a snow-covered surface SG will be described.

First, the lifting operating lever 15 configured to switch the usage and storage position of the blade 20 is pressed in an arrow a direction in FIG. 1.

The lifting operating lever 15 is rotated in a counterclockwise direction in FIG. 1 using the support shaft 15*a* as a supporting point, and the inner cable 16*b* of the operating wire cable 16, the distal end portion 16*c* of which is joined to a distal end portion of the portion 15*c* under the support shaft 15*a*, is pulled. As a result, the proximal end portion 23*d* of the operating arm 23, which is joined to the proximal end portion 16*d* of the inner cable 16*b*, is pulled, and the operating arm 23 is rotated clockwise using the support shaft 23*a* as a supporting point.

The arm 23 is gradually raised from a state in which the arm 23 is inclined toward a side in FIG. 1 by the rotating of the operating arm 23, and the rollers 24 of the distal end portion 23*b* are driven on an upper edge portion 20*f* between the L-shaped stopper part 20*d* and the chevron-shaped stopper 20*e* of the blade 20.

Thus, the blade 20 is rotated against the return spring 21 in a clockwise direction in FIG. 1 using the support shaft 20*b* as the supporting point, the blade 20 is further lowered to come into contact with the snow-covered surface SG, the snow plow is lifted up to a height at which the wheels 18 do not come into contact with the snow-covered surface SG, and a lower surface of the blade 20 comes into contact with the snow-covered surface SG.

The blade 20 is set to a usage position B in the above-described state, which is a position at which this state can be held, and the snow plow can be moved on the snow-covered surface SG.

In this state, the snow plow 1 is moved on the snow-covered surface SG.

Since the snow plow 1 is moved on the snow-covered surface SG using the blade, resistance is small or extremely small. Thus, the snow plow can easily be moved on the snow-covered surface SG with little effort.

This state is shown in FIG. 2.

Note that, since the lifting operating lever 15 is pulled in an arrow b direction in FIG. 2, a pulling force of the operating arm 23 is released, and an operating force of the operating arm 23 using the inner cable 16*b* is released.

The blade 20 is lifted by an elastic return action of the return spring 21, the rollers 24 are driven on the upper edge portion 20*f* of the blade 20, the rollers 24 are regulated by a base portion of the L-shaped stopper part 20*d* serving as an end portion of the upper edge portion 20*f*, and the blade 20 in FIG. 1 returns to the storage position A.

Figure 3:
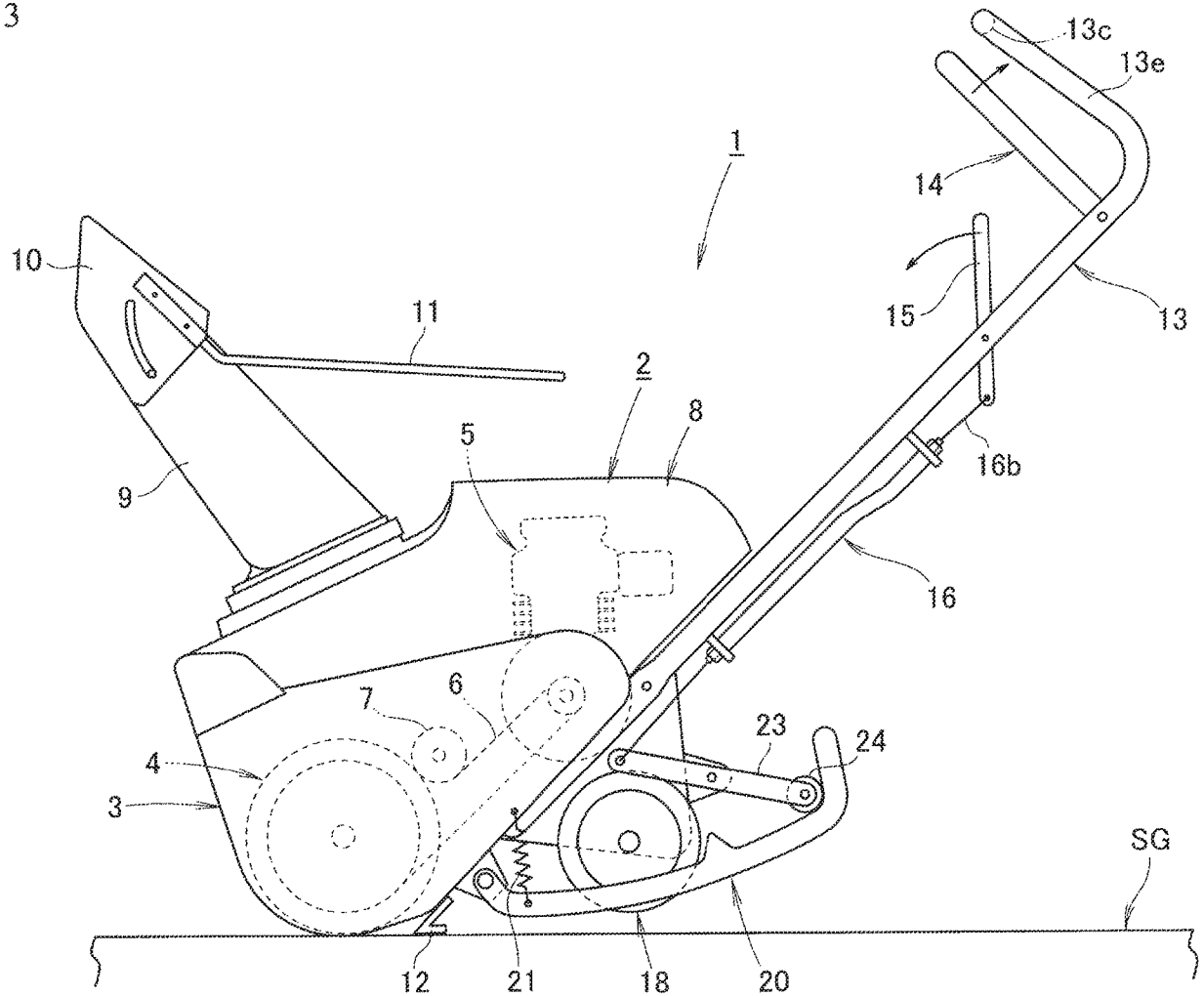
FIG. 3 is a side view of the external appearance of the snow plow related to the first embodiment of FIG. 1 in a state in which the snow plow removes snow.

FIG. 3 is a side view of the external appearance of the snow plow related to the first embodiment of FIG. 1 in a state in which the snow plow removes snow.

In the snow plow 1, the user grips and lifts the gripping parts 13*e* of the operating handle 13 in a state in which the blade 20 is stored, and thus the blade 20 and the wheels 18 float above the snow-covered surface SG. Thus, the blade 20 and the wheels 18 do not perform a snow removal task.

A front opening of the auger housing 3 is directed slightly downward in this state. Thus, snow introduced into the auger housing 3 is gathered toward a central portion by the auger 4, is input to the chute 9 by a blower (not shown), and is discharged through the guide cone 10.

Figure 4:
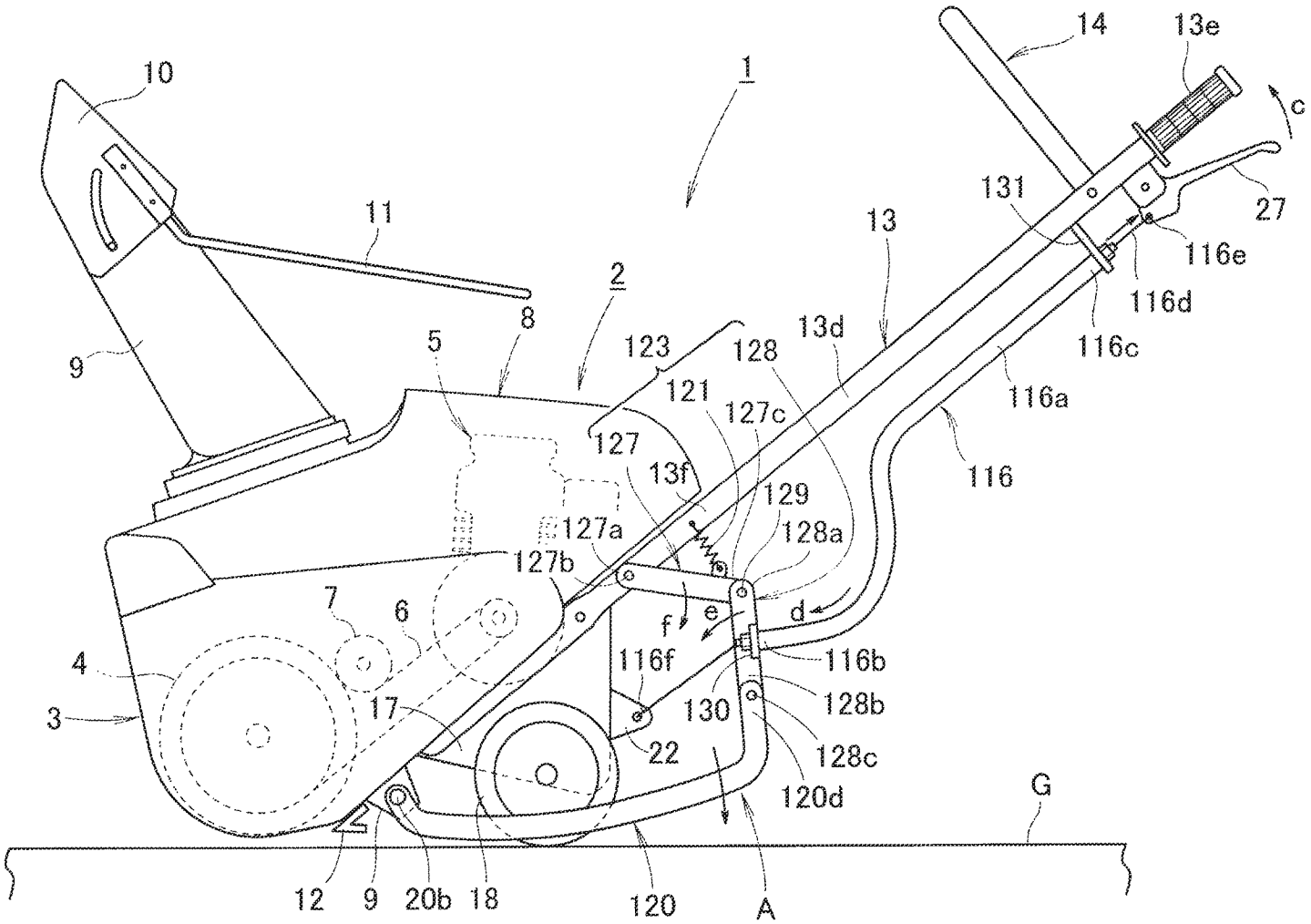
FIG. 4 is a side view showing an external appearance of a snow plow related to a second embodiment of the present invention, and is a view showing a state in which the snow plow can be moved on wheels.

FIG. 4 is a side view showing an external appearance of a snow plow related to a second embodiment of the present invention, and is a view showing a state in which the snow plow can be moved by wheels.

A basic constitution of the snow plow and devices subordinate to the snow plow is the same as the basic constitution of the above-described first embodiment. Thus, the same parts are denoted with the same reference numerals, and the descriptions thereof will be omitted.

In this embodiment, a constitution of a usage and storage positional selecting mechanism 123 (hereinafter referred to as a "selecting mechanism") configured to select and set usage positions or storage positions of the blade 120 is different from that of the first embodiment. Thus, a constitution thereof will be described in detail.

Figure 6:
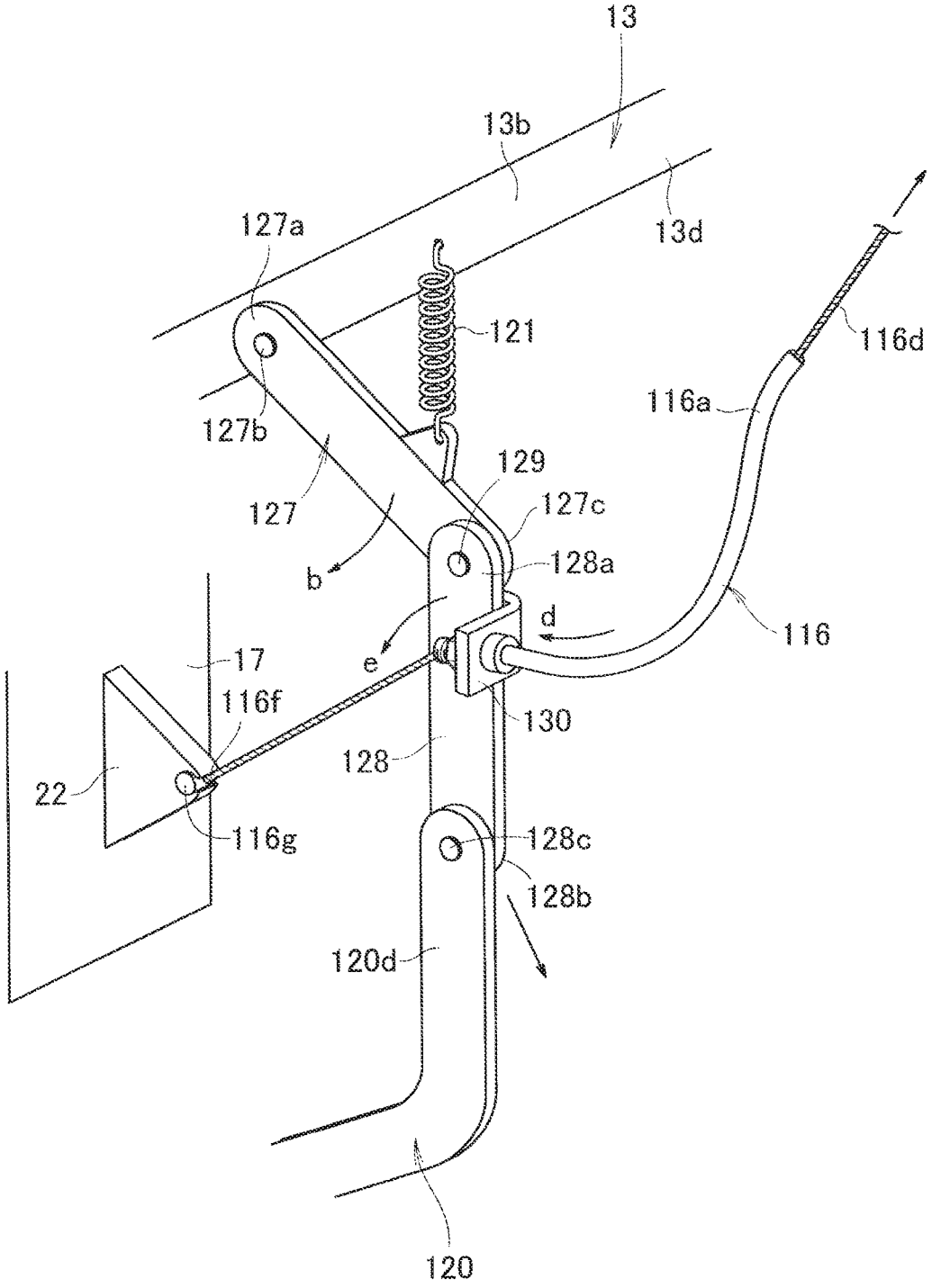
FIG. 6 is an enlarged perspective view showing a main part of a swing actuating mechanism of a blade.

Note that FIG. 6 shows an enlarged main part of the selecting mechanism 123. The selecting mechanism 123 will be described with reference to the drawing.

The selecting mechanism 123 is provided at a portion 13*f* which is near a distal portion of one of left and right side rod portions 13*d* of an operating handle 13, and is a link mechanism constituted of two link pieces 127 and 128.

A proximal end portion 127*a* of one link piece 127 (a first link piece) of the link pieces is disposed in a pivoting manner at the portion 13*f* near the distal portion of the side rod portion 13*d* of the operating handle 13 using a pin 127*b*, and the other end portion 127*c* is disposed in a pivoting manner at the distal end portion 128*a* of the other link piece 128 using a pin 129.

A proximal end portion 128*b* of the other link piece 128 (a second link piece) is disposed in a pivoting manner at a distal end portion of an L-shaped part 120*d* of the blade 120 using a pin 128*c*.

As described above, an intermediate portion of the second link piece 128 in a longitudinal direction thereof is rigidly joined to a proximal end portion 116*b* of an outer cable 116*a* (an outer tube) of an operating wire cable 116 with high rigidity via a stay 130.

A distal end portion 116*c* of the outer cable 116*a* is rigidly joined to a portion which is near one of gripping parts 13*e* of the handle 13 via a stay 131.

The operating wire cable 116 is a cable with high rigidity as described above, and the wire cable 116 having at least the outer cable 116*a* with high rigidity is selected.

The operating wire cable 116 extends between the stays 130 and 131 while a portion or most of the wire cable 116 is bent in a state in which the wire cable 116 is steeply bent at a position at which the blade 120 is stored as shown in FIG. 4.

A distal end portion 116*e* of an inner cable 116*d* which passes through the outer cable 116*a* is joined to an lifting operating lever 27 (operating member) which is provided near the gripping part 13*e* of the handle 13, and a proximal end portion 116*f* of the inner cable 116*d* is joined to a bracket 22 provided at the base 17.

In the embodiment, the proximal end portion 116*f* of the inner cable 116*d* is joined to the bracket 22 using a coupler 116*g* (refer to FIG. 6).

A return spring 121 (biasing member) extends between an intermediate portion of the first link piece 127 serving as a link mechanism which constitutes the selecting mechanism 123 and an operating handle (a machine body side).

In FIG. 4, the blade 120 is at a raised position and is separated from a non-snow-covered surface G that is, at a storage position A. The second embodiment and the first embodiment are alike in that, when the wheels 18 come into contact with the non-snow-covered surface G and the snow plow is moved while the user grips the operating handle 13 in this state, resistance is small and thus the snow plow can be easily moved with a small force because the snow plow is moved on the wheels 18.

Next, movement on a snow-covered surface SG will be described.

First, an operating lever 27 configured to switch the usage and storage position of the blade 120 is gripped and pressed in an arrow c direction in FIG. 4.

Thus, since the inner cable 116*d* which passes through the outer cable 116*a* is pulled and the inner cable 116*d* is joined to the bracket 22 of the machine body 2 side, the outer cable 116*a* is pressed in a direction in which flexure thereof expands (an arrow d direction in FIG. 4).

Thus, the second link piece 128 is pressed and rotated in an arrow e direction in FIG. 4, and the first link piece 127, which is disposed in the pivoting manner using the pin 129, is pressed and rotated in an arrow f direction in FIG. 4 (also refer to FIG. 6).

The link pieces 127 and 128, which are in a bent state, are shifted to have a linear shape against the return spring 121, pins (support shafts) 127*b*, 129, and 128*c* serving as a point at which the link pieces 127 and 128 are disposed in the pivoting manner are arranged in a linear shape to constitute a so-called dead point, and the lowered blade 120 is held at a corresponding position.

Figure 5:
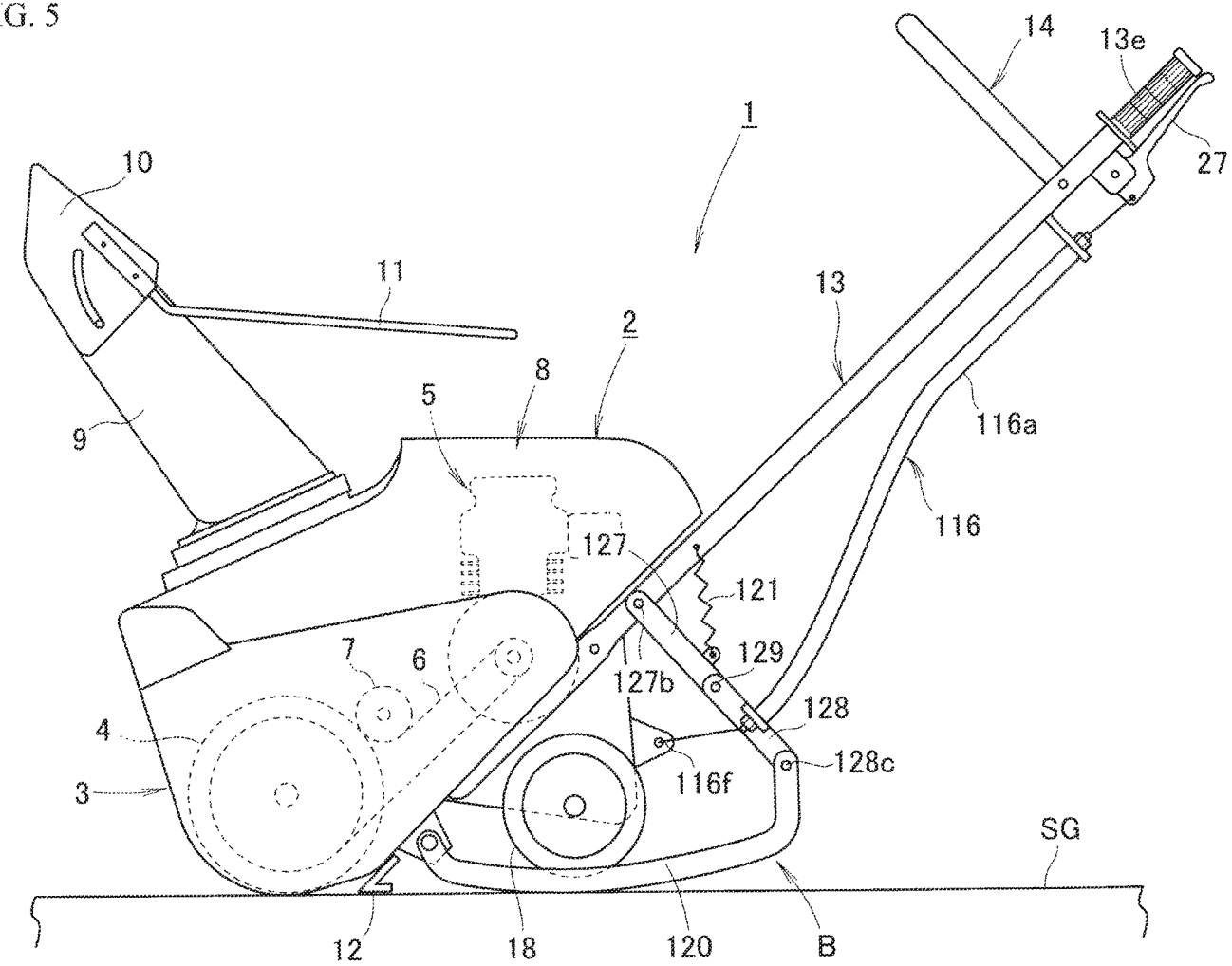
FIG. 5 is a side view of the external appearance of the snow plow in which a blade of the snow plow related to the second embodiment of FIG. 4 is lowered and which is moved on a snow-covered surface.

This state is shown in FIG. 5, and thus the blade 120 is lowered to a position lower than lower surfaces of the wheels 18 and comes into contact with the snow-covered surface SG, the snow plow is lifted up to a height at which the wheels 18 do not come into contact with the snow-covered surface SG, and the lower surface of the blade 120 does come into contact with the snow-covered surface SG.

The blade 120 is set to a usage position B in this state, the blade 120 is lowered and the usage position thereof is held as described above, and thus the snow plow can be moved on the snow-covered surface SG.

The snow plow 1 is moved on the snow-covered surface SG in this state.

Since the snow plow 1 is moved on the snow-covered surface SG using the blade 120, resistance is small or extremely small. Thus, the snow plow can be easily moved on the snow-covered surface SG with little effort.

This state is shown in FIG. 5.

Note that, in the present invention, an operating link rod can be constituted instead of the operating wire cables 16 and 116. Therefore, the operating arm 23 can be operated via the operating link rod using the lifting operating lever 15. Also, the selecting mechanism 123 can be operated via the operating link rod using the lifting operating lever 27.

What is claimed is:

1. A snow plow, comprising:

a snow plowing part in a front of a machine body having a wheel and a blade; and an operating handle extending rearward from the machine body, wherein the blade is provided at the machine body to be able to be lifted or lowered between a storage position at which the blade is lifted above a lowermost surface of the wheel and a usage position at which the blade is lowered below the lowermost surface of the wheel;

wherein any one of the operating handle and the machine body includes an operating member configured to operate the blade such that the blade is lifted or lowered between the storage position and the usage position;

wherein a front end portion of the blade is pivotably supported on the machine body to swing freely; and wherein a swing distal end portion of the blade is joined to the operating member and is lifted or lowered by the operating member.

2. The snow plow according to claim 1, wherein the blade is biased by a biasing member in a direction in which the swing distal end portion of the blade swings upward, the swing distal end portion of the blade is joined to the operating member via a swing actuating mechanism, and wherein the swing actuating mechanism is a converting mechanism configured to convert an operating force of the operating member into a force by which the swing distal end portion of the blade swings downward.

3. The snow plow according to claim 2, wherein the swing actuating mechanism is constituted of a wire cable which has an inner cable and an outer tube and an arm of which middle in a longitudinal direction is supported by the machine body to be able to swing vertically, wherein both ends of the outer tube are fixed to the machine body, wherein one end of the inner cable is joined to the operating member, wherein the other end of the inner cable is joined to one end portion of the arm, and wherein the other end portion of the arm is engaged such that the swing distal end portion of the blade is able to be pressed downward.

4. The snow plow according to claim 2, wherein the swing actuating mechanism is constituted of a wire cable which has an inner cable and an outer tube and a link mechanism configured to join the swing distal end portion of the blade to the machine body to be able to swing vertically, wherein the outer tube is disposed to be curved, wherein one end of the outer tube is joined to the machine body, wherein the other end of the outer tube is joined to the link mechanism, wherein one end of the inner cable is joined to the operating member, and wherein the other end of the inner cable is joined to the machine body.

* * * * *